US006532355B2

(12) United States Patent
Saitoh et al.

(10) Patent No.: US 6,532,355 B2
(45) Date of Patent: Mar. 11, 2003

(54) TONER RECYCLING DEVICE AND METHOD, AND IMAGE FORMING APPARATUS AND METHOD USING THE TONER RECYCLING DEVICE

(75) Inventors: Hiroshi Saitoh, Ichikawa (JP); Hiroshi Ishii, Zushi (JP); Toshihiro Sugiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/998,322

(22) Filed: Dec. 3, 2001

(65) Prior Publication Data

US 2002/0067938 A1 Jun. 6, 2002

(30) Foreign Application Priority Data

Dec. 1, 2000 (JP) ..... 2000-367433

(51) Int. Cl.[7] ..... G03G 21/10
(52) U.S. Cl. ..... 399/359
(58) Field of Search ..... 399/358, 359, 399/360

(56) References Cited

FOREIGN PATENT DOCUMENTS

| | | |
|---|---|---|
| JP | 10-039610 | 2/1998 |
| JP | 11-073079 | 3/1999 |
| JP | 2002-169438 * | 6/2002 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A toner recycling device of an electrophotographic image forming apparatus conveys collected used toner to a developing device of the image forming apparatus. The toner recycling device includes a powder conveying pump that is driven to convey the collected used toner to the developing device of the image forming apparatus when an integrated value of predetermined numerical values, each based on a number of picture elements of an image to be formed, is equal to or greater than a constant value, and an adding device that adds a predetermined constant value to the integrated value when driving of an image bearing member of the image forming apparatus is detected.

38 Claims, 7 Drawing Sheets

FIG. 7

| n | Vref−Vt |
|---|---|
| 3 | Vref−Vt≦−0.2 |
| 2 | −0.2<Vref−Vt≦−0.1 |
| 1.5 | −0.1<Vref−Vt≦−0.05 |
| 1 | −0.05<Vref−Vt |

TONER RECYCLING DEVICE AND METHOD, AND IMAGE FORMING APPARATUS AND METHOD USING THE TONER RECYCLING DEVICE

CROSS REFERENCE TO RELATED APPLICATION

The present application claims priority and contains subject matter related to Japanese Patent Application No. 2000-367433 filed in the Japanese Patent Office on Dec. 1, 2000, and the entire contents of which are hereby incorporated by reference.

BACKGROUND OF THE INVENTION

1. Field of the Invention

The present invention relates to a toner recycling device of electrophotographic image forming apparatuses such as copying machines, printers, facsimile apparatuses, multi-functional apparatuses, etc.

2. Discussion of the Background

An electrophotographic image forming apparatus forms a toner image on a photoconductor by performing charging, optical writing, and developing operations. The toner image formed on the photoconductor is transferred onto a sheet either directly from the photoconductor or via an intermediate transfer member, and thereby an image is recorded on the sheet. After the toner image is transferred onto the sheet, respective residual toner on the photoconductor and the intermediate transfer member are removed by cleaning devices for subsequent image formation starting with a charging operation.

Recently, in such electrophotographic image forming apparatuses, from the view points of effective use of resources, protection of the environment, and reduction of the maintenance expenses, it is widely practiced to recycle residual toner collected by a cleaning device without discarding the collected residual toner. The collected residual toner is transferred to a developing device to be mixed with a new toner for subsequent use.

A known toner recycling device, which recycles residual toner collected by a cleaning device to a developing device, fluidizes and conveys the collected residual toner to the developing device using a powder conveying pump called a Monau pump. In such a toner recycling device, however, if the powder conveying pump is always driven, the airtightness of the powder conveying pump is deteriorated due to abrasion, so that toner scattering is caused, the life of the powder conveying pump is reduced, and the temperature of the pump rises.

Accordingly, a known toner recycling device using a powder conveying pump includes a detecting device to detect the amount of collected toner (e.g., a powder sensor) in a toner reservoir, and is configured such that when the detecting device detects that the collected toner amount has reached a predetermined amount, the powder conveying pump is driven for a predetermined period of time.

The present inventors realized that to eliminate such a collected toner amount detecting device by providing a counting device for counting the number of picture elements of an image which is formed. The picture element counting device counts the number of picture elements of an image which is formed, and based upon the integrated value of the number of picture elements, the toner consumption amount is calculated. When the calculated toner consumption amount reaches a predetermined value, the collected toner amount in the toner reservoir is determined to reach a predetermined amount, and then a powder conveying pump is driven.

In a copying operation in an image forming apparatus, a photocoductor starts to rotate when a sheet starts to be fed from a sheet cassette and continues to rotate until the sheet is discharged from the apparatus. Accordingly, in a one-to-one copying operation in which one copy is obtained from one original, the rotating period time of the photoconductor per one copy is longer than in a continuous copying operation in which a plurality of images are successively obtained from one original. As the rotating period of time of the photoconductor per one copy increases, the background soiling of the photoconductor increases, and thereby causes an increase in toner consumption and consequently an increase in the amount of collected residual toner per one picture element.

The increase in the amount of collected residual toner is significant as the image ratio in an image to be formed is smaller. For example, when the image ratio of an image to be formed is about 5%, the amount of collected residual toner in the one-to-one copying operation is about three to five times of that in the continuous copying operation. That is, depending upon whether the ratio of one-to-one copying operations is greater or smaller than that of continuous copying operations, the amount of collected residual toner greatly varies.

A powder conveying pump is always driven minimally, considering the above-described variation in the amount of collected residual toner. Therefore, generally, the amount of consumed toner per one picture element is set adjusted to the amount for the one-to-one copying operation, and the powder conveying pump is driven when it is detected the toner consumption amount, which is calculated based upon the integrated value of the number of picture elements, reaches a predetermined value.

Accordingly, when the ratio of continuous copying operations is greater than that of one-to-one copying operations, the time when the powder conveying pump is driven unnecessarily increases. Thereby, airtightness of the powder conveying pump is deteriorated due to abrasion, toner scattering is caused, the life of the powder conveying pump is reduced, and the temperature of the pump rises.

Further, the amount of collected residual toner which is conveyed to a developing device by the powder conveying pump varies due to the deterioration of the airtightness of the powder conveying pump, causing instability to the mixture ratio of the collected residual toner relative to a new toner, and consequently decreasing the image quality.

Furthermore, depending upon the density of a toner image, the amount of collected residual toner per one picture element greatly varies.

SUMMARY OF THE INVENTION

The present invention has been made in view of the above-discussed and other problems and addresses the above-discussed and other problems.

Preferred embodiments of the present invention provide a novel toner recycling device of an electrophotographic image forming apparatus, in which the amount of collected residual toner is precisely detected in accordance of the copying mode so that a driving interval of a powder conveying pump is enlarged and at the same time the ratio of recycled toner in a developer is made constant so that the image quality is improved.

The preferred embodiments of the present invention further provide a novel toner recycling device of an electrophotographic image forming apparatus, in which the amount of collected toner is precisely detected in accordance of the density of a toner image so that a driving interval of a powder conveying pump is enlarged and at the same time the ratio of recycled toner in a developer is made constant so that the image quality is improved.

The preferred embodiments of the present invention also provide a method of precisely detecting the density of a toner image based upon an objective criterion and of precisely detecting the amount of collected residual toner.

Further, the preferred embodiments of the present invention provide a method of avoiding useless driving of a powder conveying pump so that the life of the powder conveying pump is increased.

According to a preferred embodiment of the present invention, a toner recycling device of an electrophotographic image forming apparatus conveys collected used toner to a developing device of the image forming apparatus. The toner recycling device includes a powder conveying pump that is driven to convey the collected used toner to the developing device of the image forming apparatus when an integrated value of predetermined numerical values, each based on a number of picture elements of an image to be formed, is equal to or greater than a constant value, and an adding device that adds a predetermined constant value to the integrated value when driving of an image bearing member of the image forming apparatus is detected.

According to another preferred embodiment of the present invention, a toner recycling device of an electrophotographic image forming apparatus to convey collected used toner to a developing device of the image forming apparatus includes a powder conveying pump that is driven to convey the collected used toner to the developing device of the image forming apparatus when an integrated value of predetermined numerical values, each based on a number of picture elements of an image to be formed, is equal to or greater than a constant value, and a coefficient determining device that determines a predetermined coefficient according to toner density of a developer of the image forming apparatus and that corrects each of the predetermined numerical values by multiplying the each of the predetermined numerical values by the coefficient.

According to still another preferred embodiment of the present invention, a toner recycling device of an electrophotographic image forming apparatus to convey collected used toner to a developing device of the image forming apparatus includes a powder conveying pump that is driven to convey the collected used toner to the developing device of the image forming apparatus when an integrated value of predetermined numerical values, each based on a number of picture elements of an image to be formed, is equal to or greater than a constant value, an adding device that adds a predetermined constant value to the integrated value when driving of an image bearing member of the image forming apparatus is detected, and a coefficient determining device that determines a predetermined coefficient according to toner density of a developer of the image forming apparatus and that corrects each of the predetermined numerical values by multiplying the each of the predetermined numerical values by the coefficient.

In the above-described toner recycling devices, the coefficient may be determined according to a difference between the toner density of the developer and a target value for the toner density. Further, the powder conveying pump may be stopped to be driven a predetermined time after having been started to be driven.

According to still another preferred embodiment of the present invention, an electrophotographic image forming apparatus includes a developing device to develop a latent image formed on a photoconductor with a toner, and a toner recycling device that conveys collected used toner to the developing device. The toner recycling device includes a powder conveying pump that is driven to convey the collected used toner to the developing device when an integrated value of predetermined numerical values, each based upon a number of picture elements of an image to be formed, is equal to or greater than a constant value, and an adding device that adds a predetermined constant value to the integrated value when driving of the photoconductor is detected.

According to still another preferred embodiment of the present invention, an electrophotographic image forming apparatus includes a developing device to develop a latent image formed on a photoconductor with a toner, and a toner recycling device to convey collected used toner to the developing device. The toner recycling device includes a powder conveying pump that is driven to convey the collected used toner to the developing device when an integrated value of predetermined numerical values, each based on a number of picture elements of an image to be formed, is equal to or greater than a constant value, and a coefficient determining device that determines a predetermined coefficient according to toner density of a developer of the image forming apparatus and that corrects each of the predetermined numerical values by multiplying the each of the predetermined numerical values by the coefficient.

According to still another preferred embodiment of the present invention, an electrophotographic image forming apparatus includes a developing device to develop a latent image formed on a photoconductor with a toner, and a toner recycling device configured to convey collected used toner to the developing device. The toner recycling device includes a powder conveying pump that is driven to convey the collected used toner to the developing device when an integrated value of predetermined numerical values, each based on a number of picture elements of an image to be formed, is equal to or greater than a constant value, an adding device that adds a predetermined constant value to the integrated value when driving of the photoconductor is detected, and a coefficient determining device that determines a predetermined coefficient according to toner density of a developer of the image forming apparatus and that corrects each of the predetermined numerical values by multiplying the each of the predetermined numerical values by the coefficient.

In the above-described electrophotographic image forming apparatuses, the coefficient may be determined according to a difference between the toner density of the developer and a target value for the toner density. Further, the powder conveying pump may be stopped to be driven a predetermined time after having been started to be driven. According to still another preferred embodiment of the present invention, a toner recycling method of an electrophotographic image forming apparatus includes driving a powder conveying pump to convey collected used toner to a developing device of the image forming apparatus when an integrated value of predetermined numerical values, each based on a number of picture elements of an image to be formed, is equal to or greater than a constant value, and adding a predetermined constant value to the integrated value when driving of an image bearing member of the image forming apparatus is detected.

According to still another preferred embodiment of the present invention, a toner recycling method of an electrophotographic image forming apparatus includes driving a powder conveying pump to convey collected used toner to a developing device of the image forming apparatus when an integrated value of predetermined numerical values, each based on a number of picture elements of an image to be formed, is equal to or greater than a constant value, and determining a predetermined coefficient according to toner density of a developer of the image forming apparatus and correcting each of the predetermined numerical values by multiplying the each of the predetermined numerical values by the coefficient.

According to still another preferred embodiment of the present invention, a toner recycling method of an electrophotographic image forming apparatus includes driving a powder conveying pump to convey collected used toner to a developing device of the image forming apparatus when an integrated value of predetermined numerical values, each based on a number of picture elements of an image to be formed, is equal to or greater than a constant value, adding a predetermined constant value to the integrated value when driving of an image bearing member of the image forming apparatus is detected, and determining a predetermined coefficient according to toner density of a developer of the image forming apparatus and correcting each of the predetermined numerical values by multiplying each of the predetermined numerical values by the coefficient.

In the above-described toner recycling methods, in the determining step the coefficient may be determined according to a difference between the toner density of the developer and a target value for the toner density. Further, in the driving step the powder conveying pump may be stopped to be driven a predetermined time after having been started to be driven.

According to still another preferred embodiment of the present invention, an electrophotographic image forming method includes developing a latent image formed on a photoconductor with a toner, and recycling collected used toner to a developing device. The recycling includes driving a powder conveying pump to convey the collected used toner to the developing device when an integrated value of predetermined numerical values, each based on a number of picture elements of an image to be formed, is equal to or greater than a constant value, and adding a predetermined constant value to the integrated value when driving of the photoconductor is detected.

According to still another preferred embodiment of the present invention, an electrophotographic image forming method includes developing a latent image formed on a photoconductor with a toner by a developing device, and recycling collected used toner to the developing device. The recycling includes driving a powder conveying pump to convey the collected used toner to the developing device when an integrated value of predetermined numerical values, each based on a number of picture elements of an image to be formed, is equal to or greater than a constant value, and determining a predetermined coefficient according to toner density of a developer of the image forming apparatus and correcting each of the predetermined numerical values by multiplying the each of the predetermined numerical values by the coefficient.

According to still another preferred embodiment of the present invention, an electrophotographic image forming method includes developing a latent image formed on a photoconductor with a toner by a developing device, and recycling collected used toner to the developing device. The recycling includes driving a powder conveying pump to convey the collected used toner to the developing device when an integrated value of predetermined numerical values, each based on a number of picture elements of an image to be formed, is equal to or greater than a constant value, adding a predetermined constant value to the integrated value when driving of the photoconductor is detected, and determining a predetermined coefficient according to toner density of a developer of the image forming apparatus and for correcting each of the predetermined numerical values by multiplying the each of the predetermined numerical values by the coefficient.

In the above-described image forming methods, in the determining step the coefficient may be determined according to a difference between the toner density of the developer and a target value for the toner density. Further, in the driving step the powder conveying pump may be stopped to be driven a predetermined time after having been started to be driven.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein:

FIG. 7 is a setting table used in driving the toner recycling device.

DETAILED DESCRIPTION OF THE PREFERRED EMBODIMENTS

Figure 1:
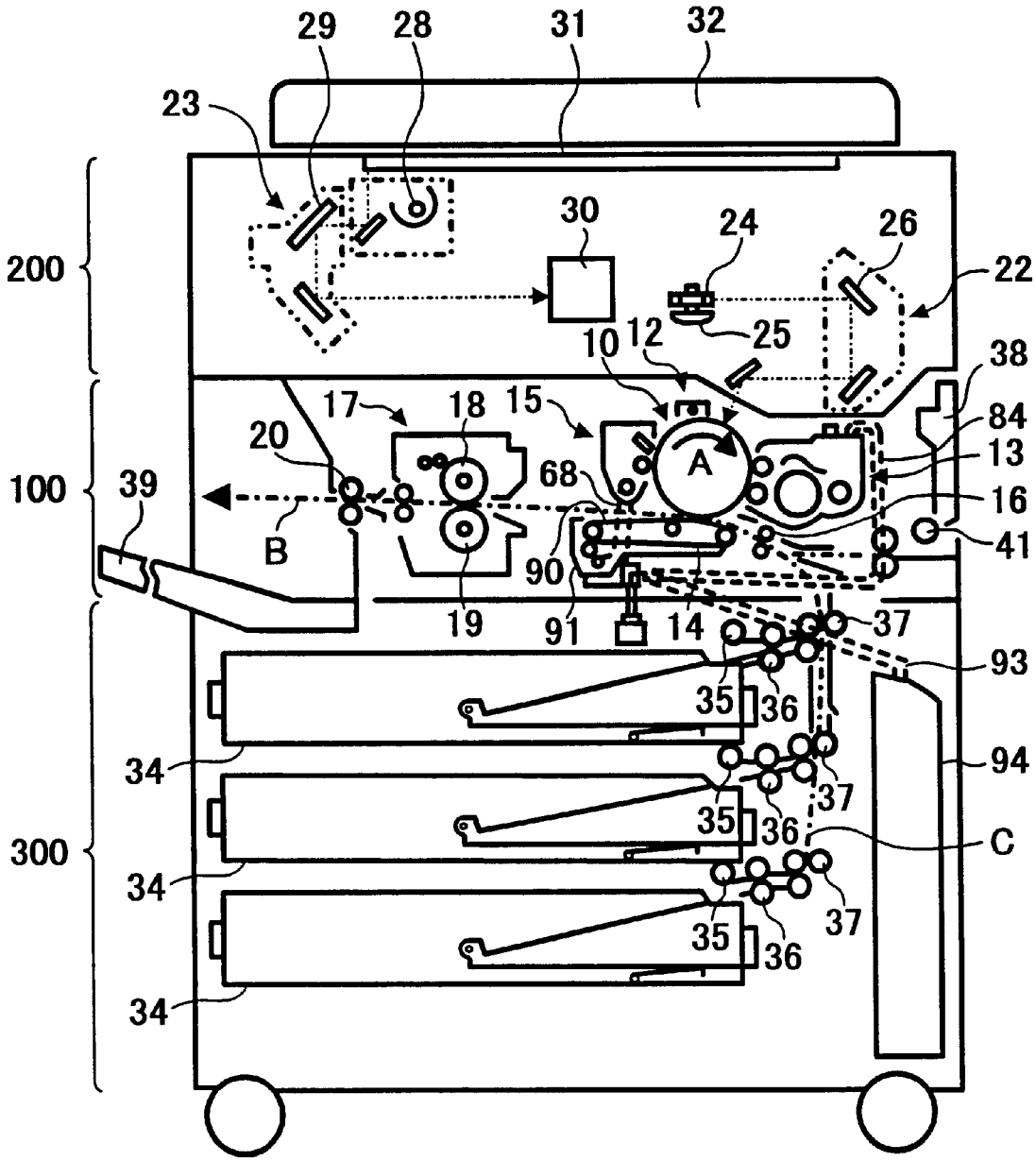
FIG. 1 is a schematic drawing illustrating a construction of a digital copying machine according to a preferred embodiment of the present invention.

Referring now to the drawings, wherein like reference numerals designate identical or corresponding parts throughout the several views, preferred embodiments of the present invention are described.

FIG. 1 illustrates a schematic construction of a digital copying machine according to a preferred embodiment of the present invention. Reference 100 denotes a main body of the digital copying machine. A reading and writing device 200 is mounted on the main body 100, and the main body 100 is mounted on a sheet feeding device 300 which is shaped like a table.

A drum-like-shaped photoconductor 10 is provided inside the main body 100. Around the photoconductor 10 provided are a charging device 12, a developing device 13, a transfer and conveying device 14, and a cleaning device 15 in this order in a rotating direction "A" of the photoconductor 10.

A sheet conveying path "B" is formed in the main body 100 to convey a sheet from right to left in FIG. 1, passing between the photoconductor 10 and the transfer and conveying device 14. A registration roller 16 is provided in the sheet conveying path B upstream of the photoconductor 10 in a sheet conveying direction. A fixing device 17 is provided along the sheet conveying path B downstream of the photoconductor 10. The fixing device 17 includes a fixing roller 18 having a heater inside and a pressing roller 19 pressed against the fixing roller 18 from below. A discharging roller 20 is arranged left of the fixing device 17 in the figure.

The reading and writing device 200 includes a laser writing device 22 and an original reading device 23. The laser writing device 22 includes, for scanning, a laser light source (not shown), a rotating multi-faced mirror 24, a polygon motor 25, and a scanning optical system including a fθ lens, etc. The original reading device 23 includes a light source 28, a plurality of mirrors 29, and an image sensor 30 (e.g., a CCD, etc.).

The main body 100 further includes a contact glass 31 at an upper surface thereof, and an original pressing plate 32 is provided at the upper surface so as to open and close and to cover the contact glass 31 when closed.

The sheet feeding device 300 includes multiple feeding cassettes 34 arranged inside in a multistage manner. Each of the cassettes 34 has a feeding roller 35 and a separating roller 36. A feeding path "C" is formed right side of the multistage feeding cassettes 34 in the figure to connect to the sheet feeding path B. Feeding rollers 37 are provided in the sheet feeding path C.

A manual feeding tray 38 for guiding a manually fed sheet to the sheet feeding path B is provided at the right side of the main body 100 in the figure so as to freely open and close. A discharging tray 39 is provided at the left side of the main body 100 in the figure to receive a sheet discharged by the discharging roller 20.

When making a copy of an original document using the above-described digital copying machine, the original document is placed on the contact glass 31 by opening the original pressing plate 32, and then a start switch (not shown) is depressed.

Then, the original reading device 23 is driven to move the light source 28 along the contact glass 33. A light from the light source 28 is reflected by the surface of the original document on the contact glass 31, the reflected light is reflected by the plurality of mirrors 29 so as to be incident onto the image sensor 30, so that the contents of the original document is read by the image sensor 30.

At the same time, the photoconductor 10 is driven by a photoconductor driving motor (not shown), the charging device 12 uniformly charges the surface of the photoconductor 10, and then the laser writing device 22 performs image writing by irradiating a laser light according to the contents of the original document read by the original reading device 23, and thereby an electrostatic latent image is formed on the surface of the photoconductor 10. The latent image is visualized by applying toner thereon with the developing device 13.

When the start switch is depressed, the feeding roller 35 of a selected one of the cassettes 34 is rotated to feed out a sheet from the selected one of the cassettes 34. The fed sheet is separated from other sheets in the selected one of the cassettes 34, and is fed into the sheet feeding path C. The sheet is fed by the conveying roller 37 to be guided to the sheet conveying path B, and the sheet is stopped by impinging upon the registration roller 16. The registration roller 16 is rotated in synchronism with a rotation of the photoconductor 10 so that the sheet is conveyed to a position below the photoconductor 10.

Alternatively, the feeding roller 41 for the manual feeding tray 38 is rotated to feed a sheet set on the manual feeding tray 38 into the sheet feeding path B. The sheet is also conveyed by the registration roller 16 in synchronism with a rotation of the photoconductor 10 so as to be conveyed to the position below the photoconductor 10.

Thereafter, a visual image on the photoconductor 10 is electrostatically transferred onto the sheet fed to the position below the photoconductor 10 by the transfer and conveying device 14. Residual toner on the photoconductor 10 after transfer of the visual image is removed by the cleaning device 15, so that the photoconductor 10 is cleaned for subsequent image formation which starts with charging by the charging device 12.

The sheet on which the visual image has been transferred from the photoconductor 10 is conveyed by the transfer and conveying device 14 to the fixing device 14, where the transferred image is fixed onto the sheet by applying heat and pressure with the fixing roller 18 and the pressing roller 19. Thereafter, the sheet is discharged onto the discharging tray 39 by the discharging roller 20 to be stacked thereupon.

Figure 2:
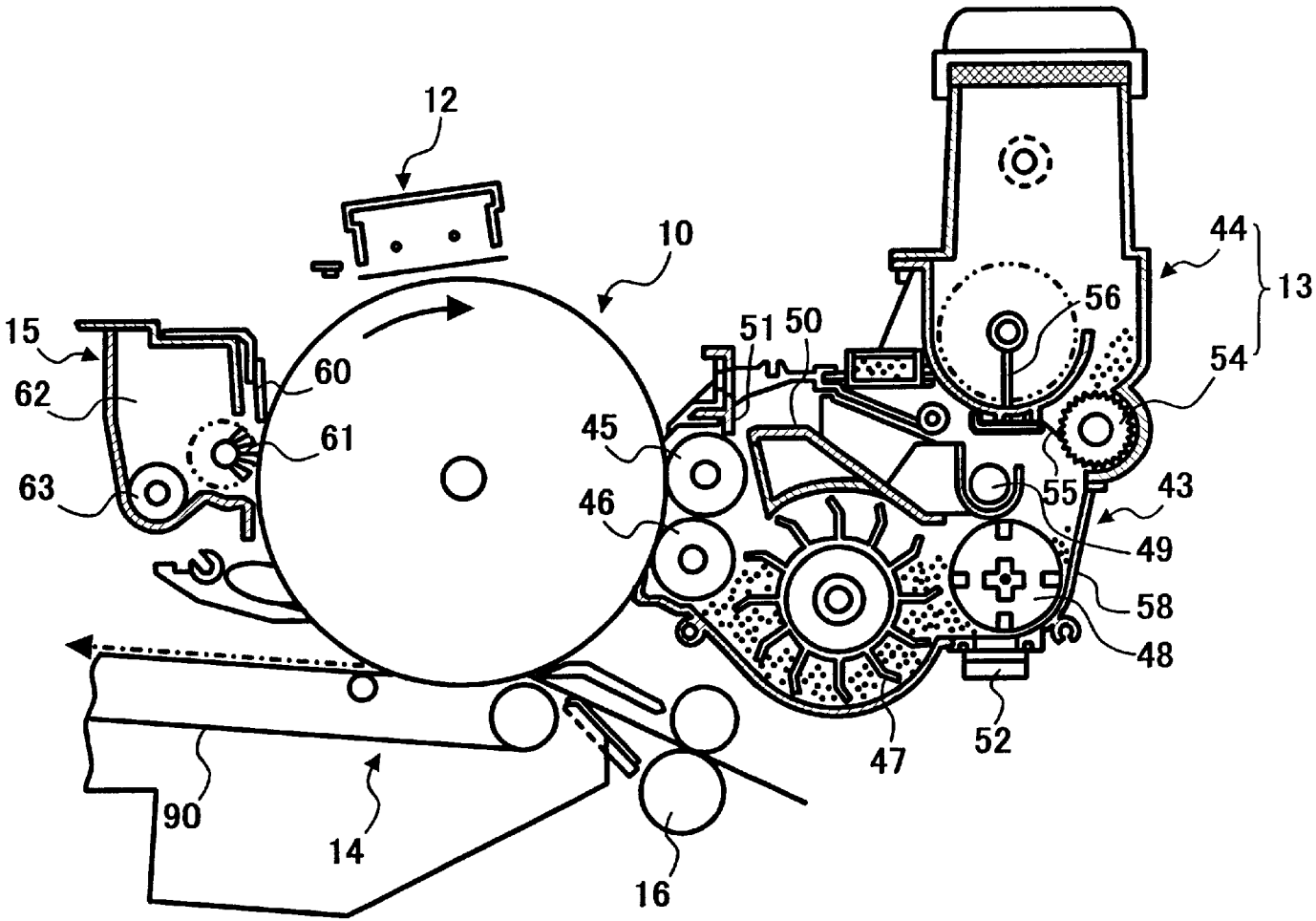
FIG. 2 is a partially enlarged drawing of the digital copying machine of FIG. 1, illustrating portions around a photoconductor.

Now, the developing device 13 is described referring to FIG. 2, which is a partially enlarged drawing of FIG. 2. The developing device 13 includes a developing tank 43 and a developing hopper 44. The developing tank 43 includes, inside of a developing case 58, a first developing roller 45, a second developing roller 46, a paddle wheel 47, a stirring roller 48, a conveying screw 49, a separator 50, a doctor blade 51, and a toner density sensor 52. A two-component developer including a toner and a developer is accommodated in the developing tank 43.

The developing hopper 44 includes a toner replenishing member 54 formed in a gear-like shape and a replenishing regulating plate 55, and an agitator 56. A toner is accommodated in the developing hopper 44.

The developing device 13 stirs the two-component developer in the developing case 58 with rotation of the stirring roller 48 so as to be charged by friction. The two-component developer is scooped up by rotation of the paddle wheel 47, and is attracted to the first developing roller 45 and the second developing roller 46 by magnets provided in the first and second developing rollers 45 and 46.

The attracted developer is conveyed by sleeves formed at the outer circumferential surfaces of the first and second developing rollers 45 and 46, and after an excessive portion of the developer is scraped by the doctor blade 51 to be removed, the developer is attracted to the photoconductor 10 by a developing bias, and thereby an electrostatic image on the photoconductor 10 is developed.

In the above-described developing device 13, when the developer is applied onto the photoconductor 10 and toner of the developer is consumed, the ratio of toner in the developer, i.e. toner density, is decreased. Therefore, when a toner density Vt of the developer is decreased to be below a predetermined value relative to a target value Vref for the toner density, the agitator 56 is rotated to stir the toner in the developing hopper 44 and at the same time the toner is conveyed to the toner replenishing device 54. The toner replenishing device 54 is rotated to vibrate the replenishing regulating plate 55, so that the toner is supplied from the developing hopper 44 to the developing tank 43. Thereby, the toner density of the developer in the developing tank 43 is maintained.

The toner density of the developer is measured by the toner density sensor 52 mounted to the developing case 58 of the developing tank 43. The target value Vref of the toner density is set based upon a value obtained by measuring a toner image for monitoring which is formed on the photoconductor 10 with a photo-sensor (not shown).

As described above, toner adhered on the photoconductor 10 is electrostatically transferred onto a sheet by the transfer and conveying device 14. In actuality, however, about 10% of the toner adhered on the photoconductor 10 is not transferred onto the sheet and remains on the photoconductor 10. The residual toner remaining on the photoconductor 10 is scraped off by a cleaning blade 60 and a brush roller 61 of the cleaning device 15.

The toner scraped off the photoconductor 10 by the cleaning device 15 is put into a collecting tank 62 of the cleaning device 15. The toner is then conveyed by a collecting screw 63 to one side of the cleaning device 15 in the axial direction of the photoconductor 10. The toner is then discharged, as illustrated in FIG. 3, from a discharging outlet 64 of the cleaning device 15 to be guided to a toner recycling device 66.

Figure 3:
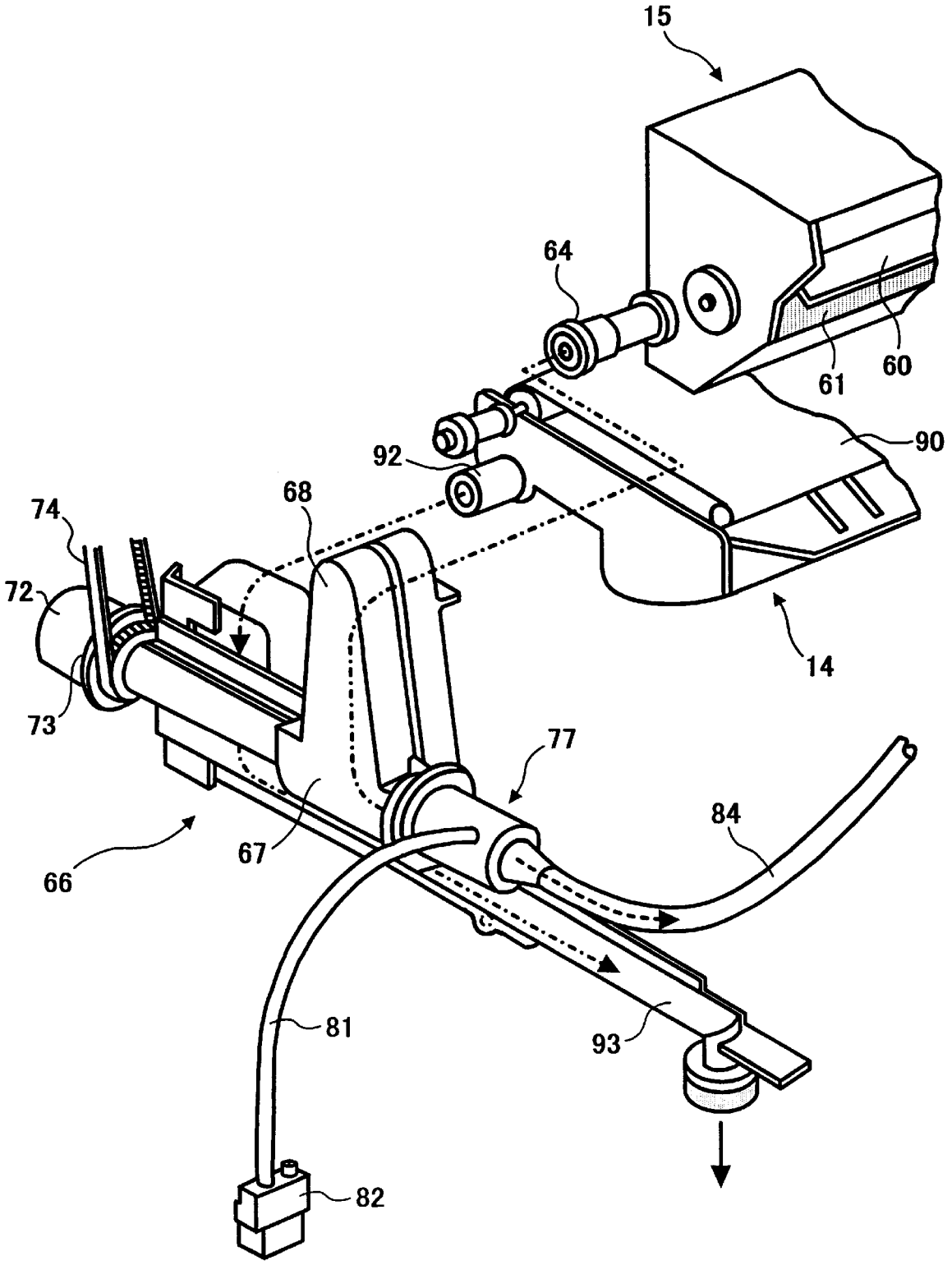
FIG. 3 is a perspective view of a toner recycling device of the digital copying machine.
Figure 4:
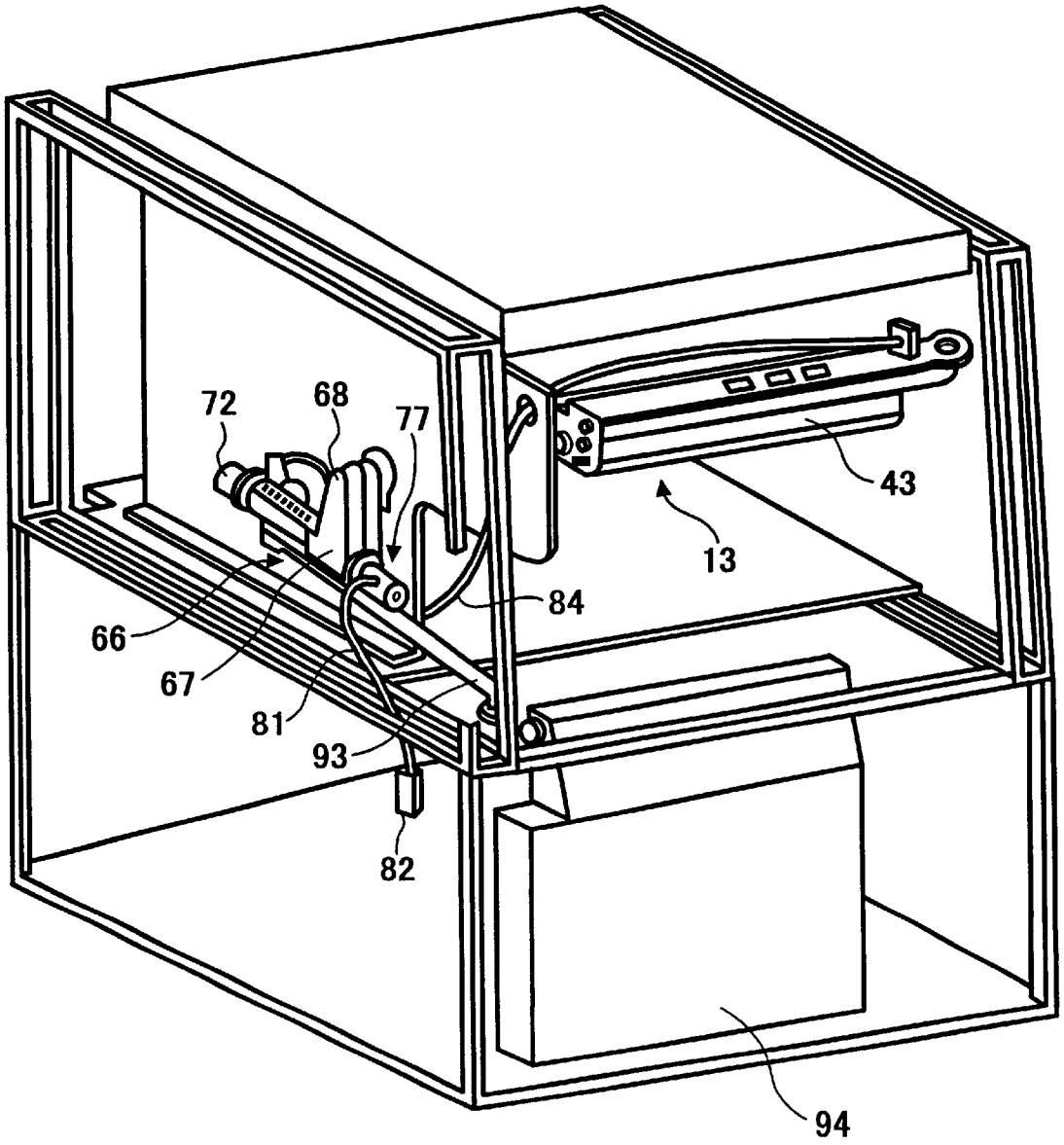
FIG. 4 is a perspective view illustrating a state that the toner recycling device is set in the digital copying machine.
Figure 5:
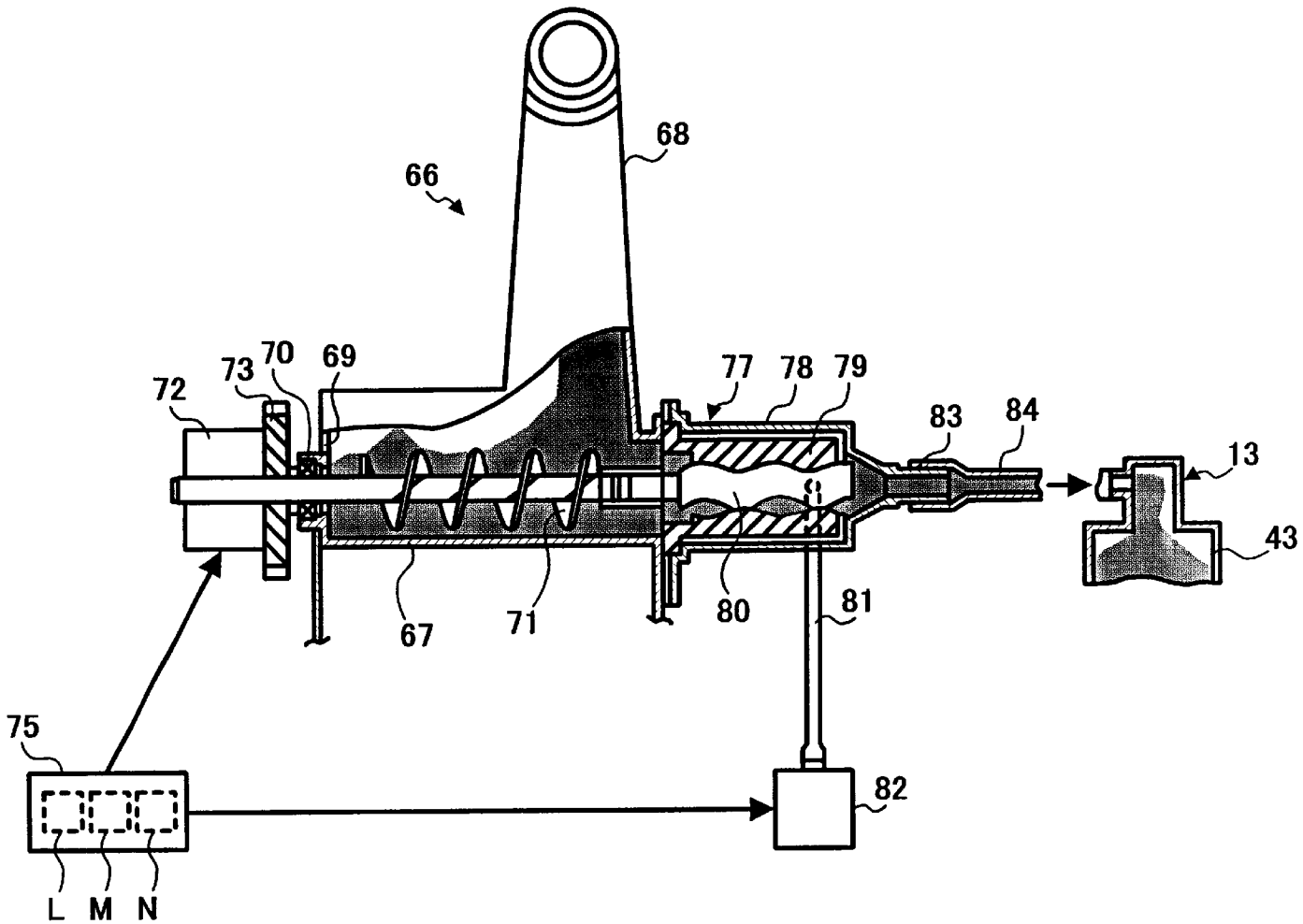
FIG. 5 is a cross section of the toner recycling device.

The toner recycling device 66 includes, as illustrated in FIGS. 3, 4, and 5, a toner guiding part 68 which is formed to protrude from a case 67 toward above. A tip end portion of the toner guiding part 68 is connected with the discharging outlet 64 of the cleaning device 15, so that collected toner discharged from the discharging outlet 64 falls down by gravity inside of the case 67.

The case 67 is sealed by a sealing member 69 (FIG. 5), and a lateral conveying screw 71 is provided inside of the case 67 so as to be supported by a bearing 70 in a freely rotatable manner. A timing pulley 73 is mounted to one end of the lateral conveying screw 71 via a clutch 72. A timing belt 74 is spanned around the timing pulley 73. The clutch 72 is turned on and off by a MPU (microprocessor unit) 75.

A powder conveying pump 77, which is called a Monau pump, is mounted to the case 67. The powder conveying pump 77 includes a holder 78 in which a stator 79 is fixed, and a rotor 80 is provided so as to enclose the stator 79. The rotor 80 is connected with the lateral conveying screw 71.

The holder 78 is connected with one end of an air tube 81, and the other end of the air tube 81 is connected with an air pump 82. The air pump 81 is turned and off by the MPU 75.

A discharging outlet 83 of the powder conveying pump 77 is connected with one end of a conveying tube 84, and the other end of the conveying tube 84 is connected with the developing tank 43 of the developing device 13.

The MPU 75 includes a powder conveying pump driving device "L" which drives the powder conveying pump 77 when the integrated value of predetermined values, each according to the number of picture elements (e.g., the number of picture elements itself, the amount of consumed toner calculated based upon t he number of picture elements or the amount of collected toner, etc.), exceeds a predetermined value, an adding device "M" which adds a predetermined value to the integrated value when driving of an image bearing member driving device (i.e., a photoconductor driving motor for driving the photoconductor 10, etc.) is detected, and a coefficient determining device "N" which determines a predetermined coefficient "n" according to toner density of the developer and which corrects each of the predetermined values by multiplying the each of the predetermined values by the coefficient n.

Figure 6:
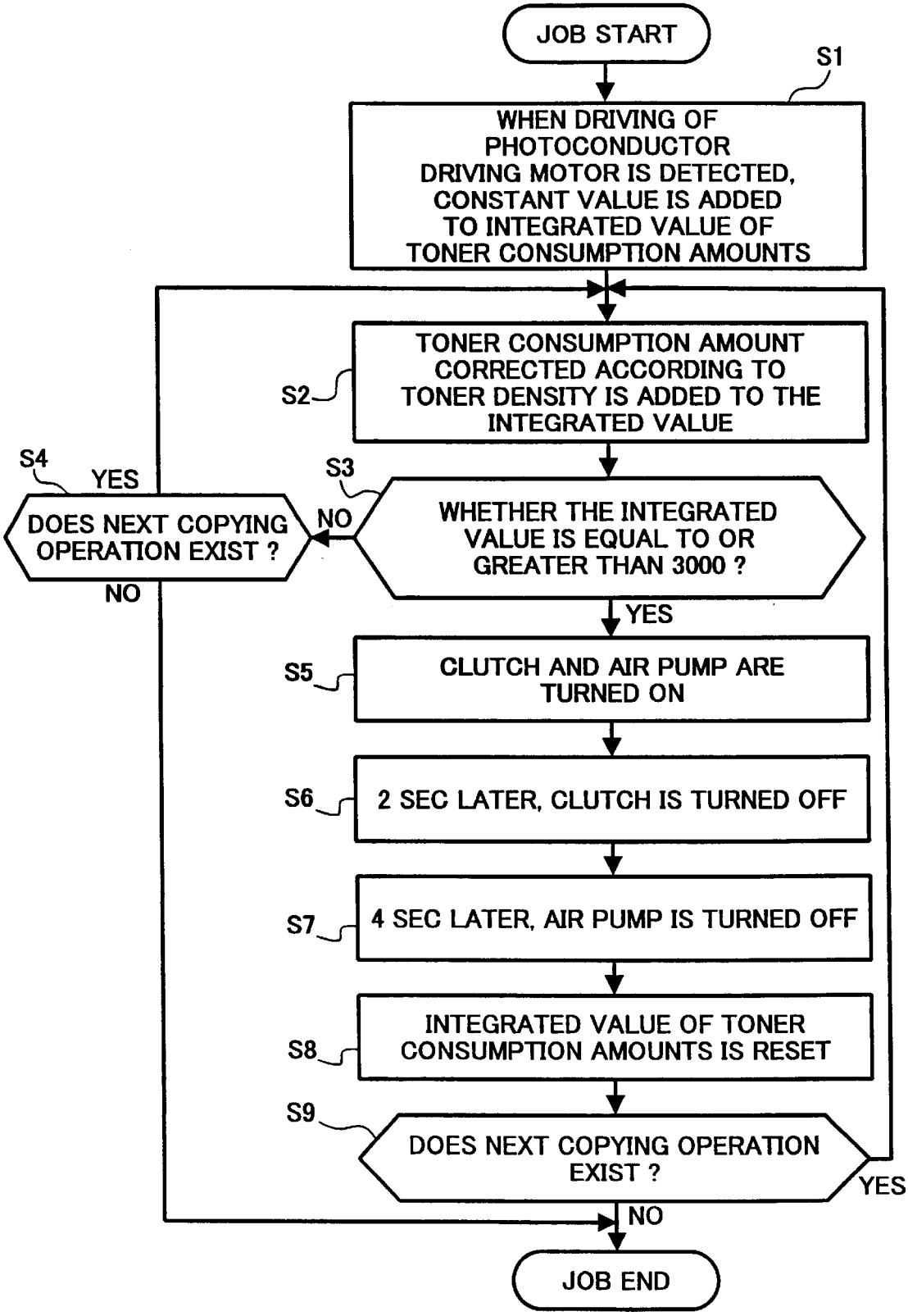
FIG. 6 is a flowchart illustrating an exemplary operation of driving the toner recycling device of the digital copying machine.

Next, an exemplary operation of driving the toner recycling device 66 is described referring to a flowchart illustrated in FIG. 6.

When a copying operation is started by depression of the start switch (not shown), in step S1, the number of picture elements of a formed image is counted, and a toner consumption amount "a" is calculated based on the counted number of picture elements. At the same time, when driving of the photoconductor driving motor (not shown) which drives the photoconductor 10 is detected, the adding device M adds a predetermined value "b" (e.g., 60 mg) to an integrated value "c" of the toner consumption amounts prior to that particular copying operation.

In step S2, the coefficient determining device N determines a predetermined coefficient "n" according to the toner density of a developer. For example, a difference between the toner density Vt of the developer and a target value Vref for the toner density is obtained, and based on the difference, using a setting table illustrated in FIG. 7, the coefficient "n" is determined. The toner consumption amount "a" is then corrected by multiplying the toner consumption amount "a" by the coefficient "n". The corrected toner consumption amount "a" is added to the integrated value "c" of the toner consumption amounts so that a new integrated value "x" of the toner consumption amounts is obtained.

In step S3, it is determined if the integrated value "x" is equal to or greater than a predetermined value "d" (e.g., 3000 mg). When the integrated value "x" is smaller than the predetermined value "d", the process proceeds to step S4. In step S4, if a next copying operation exists, the process returns to step S2, and if the next copying operation does not exist, the operation ends.

When the integrated value "x" of the toner consumption amounts is equal to or greater than the predetermined value "d", the process proceeds to step S5, where the powder pump driving device L turns on the clutch 72 and the air pump 82. The rotation of the timing pulley 73 which is rotated by rotation of the timing belt 74 is conveyed to the lateral conveying screw 71 to rotate the rotor 80 while contacting the stator 79. Thereby, the collected toner is conveyed in the axial direction of the rotor 80, is fluidized by the air from the air pump 82, and is then returned to the developing device 13 through the conveying tube 84.

In step S6, two seconds after the clutch 72 has been turned on, the clutch 72 is turned off. In step S7, four seconds after the air pump 82 has been turned on, the air pump 82 is turned off. In step S8, the integrated value "x" of the toner consumption amounts is reset.

Thereafter, in step S9, if a next copying operation exists, the process returns to step S2. If the next copying operation does not exist, the process ends.

As the background soiling of the photoconductor 10 deteriorates, the toner density Vt of the developer tends to increase relative to the target value Vref for the toner density. Accordingly, in the setting table illustrated in FIG. 7, as the background soiling of the photoconductor 10 deteriorates, the coefficient "n" increases, so that the driving interval of the powder conveying pump 77 is reduced.

For example, in copying an image of an A4 sheet having the image ratio of 5%, when Vref−Vt=0 and the coefficient "n" is 1, the powder conveying pump 77 is driven once, each time when 34 copies are made in the one-to-one copying operation, when 60 copies are made in the one-two-three copying operation, and when 100 copies are made in the one-to-500 copying operation.

In the digital copying machine of FIG. 1, because a transfer belt 90 of the transfer and conveying device 14 also contacts the photoconductor 10, toner also adheres to the transfer belt 10. Accordingly, a cleaning device 91 is provided for the transfer and conveying device 14 to scrape off residual toner on the transfer belt 90.

However, the residual toner scraped off by the transferring and conveying device 14 often contains foreign substance such as paper dust, etc. Accordingly, the residual toner scraped off by the transfer and conveying device 14 is not put into the toner recycling device 66, and instead, as illustrated in FIGS. 1, 3, and 4, falls down through a discharging outlet 92 of the cleaning device 91 by gravity to be collected by a discharged toner tank 94 through a discharging tube 93.

In the above-described embodiment, the description has been made with respect to the drum-like-shaped photoconductor 10. However, the present invention can be applied to a case in which the photoconductor 10 is belt-like shaped.

Further, in an electrophotographic image forming apparatus in which a toner image on a photoconductor is transferred onto a sheet via an intermediate transfer member, the present invention can be applied to a case in which residual toner on the intermediate transfer belt is collected in addition to collecting of residual toner on the photoconductor.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letter Patent of the United State is:

1. A toner recycling device of an electrophotographic image forming apparatus to convey collected used toner to a developing device of the image forming apparatus, comprising:

a powder conveying pump driven to convey collected used toner to a developing device of the image forming apparatus when an integrated value of predetermined numerical values, each based on a number of picture elements of an image to be formed, is equal to or greater than a constant value; and an adding device that adds a predetermined constant value to the integrated value when driving of an image bearing member of the image forming apparatus is detected.

2. The toner recycling device of claim 1, wherein the powder conveying pump is stopped to be driven a predetermined time after having been started to be driven.

3. A toner recycling device of an electrophotographic image forming apparatus to convey collected used toner to a developing device of the image forming apparatus, comprising:

a powder conveying pump that is driven to convey the collected used toner to the developing device of the image forming apparatus when an integrated value of predetermined numerical values, each based on a number of picture elements of an image to be formed, is equal to or greater than a constant value; and a coefficient determining device that determines a predetermined coefficient according to toner density of a developer of the image forming apparatus and that corrects each of the predetermined numerical values by multiplying the each of the predetermined numerical values by the coefficient.

4. The toner recycling device of claim 3, wherein the coefficient is determined according to a difference between the toner density of the developer and a target value for the toner density.

5. The toner recycling device of claim 3, wherein the powder conveying pump is stopped to be driven a predetermined time after having been started to be driven.

6. A toner recycling device of an electrophotographic image forming apparatus to convey collected used toner to a developing device of the image forming apparatus, comprising:

a powder conveying pump that is driven to convey the collected used toner to the developing device of the image forming apparatus when an integrated value of predetermined numerical values, each based on a number of picture elements of an image to be formed, is equal to or greater than a constant value;

an adding device that adds a predetermined constant value to the integrated value when driving of an image bearing member of the image forming apparatus is detected; and a coefficient determining device that determines a predetermined coefficient according to toner density of a developer of the image forming apparatus and that corrects each of the predetermined numerical values by multiplying the each of the predetermined numerical values by the coefficient.

7. The toner recycling device of claim 3, wherein the coefficient is determined according to a difference between the toner density of the developer and a target value for the toner density.

8. The toner recycling device of claim 6, wherein the powder conveying pump is stopped to be driven a predetermined time after having been started to be driven.

9. An electrophotographic image forming apparatus, comprising:

a developing device to develop a latent image formed on a photoconductor with a toner; and a toner recycling device that conveys collected used toner to the developing device, the toner recycling device including, a powder conveying pump that is driven to convey the collected used toner to the developing device when an integrated value of predetermined numerical values, each based on a number of picture elements of an image to be formed, is equal to or greater than a constant value; and an adding device that adds a predetermined constant value to the integrated value when driving of the photoconductor is detected.

10. The electrophotographic image forming apparatus of claim 9, wherein the powder conveying pump is stopped to be driven a predetermined time after having been started to be driven.

11. An electrophotographic image forming apparatus, comprising:

a developing device to develop a latent image formed on a photoconductor with a toner; and a toner recycling device to convey collected used toner to the developing device, the toner recycling device including, a powder conveying pump that is driven to convey the collected used toner to the developing device when an integrated value of predetermined numerical values, each based on a number of picture elements of an image to be formed, is equal to or greater than a constant value; and a coefficient determining device that determines a predetermined coefficient according to toner density of a developer of the image forming apparatus and that corrects each of the predetermined numerical values by multiplying the each of the predetermined numerical values by the predetermined coefficient.

12. The electrophotographic image forming apparatus of claim 11, wherein the predetermined coefficient is determined according to a difference between the toner density of the developer and a target value for the toner density.

13. The electrophotographic image forming apparatus of claim 11, wherein the powder conveying pump is stopped to be driven a predetermined time after having been started to be driven.

14. An electrophotographic image forming apparatus, comprising:

a developing device to develop a latent image formed on a photoconductor with a toner; and a toner recycling device configured to convey collected used toner to the developing device, the toner recycling device including, a powder conveying pump that is driven to convey the collected used toner to the developing device when an integrated value of predetermined numerical values, each based on a number of picture elements of an image to be formed, is equal to or greater than a constant value;

an adding device that adds a predetermined constant value to the integrated value when driving of the photoconductor is detected; and a coefficient determining device that determines a predetermined coefficient according to toner density of a developer of the image forming apparatus and that corrects each of the predetermined numerical values based on a number of picture elements by multiplying the each of the predetermined numerical values by the predetermined coefficient.

15. The electrophotographic image forming apparatus of claim 14, wherein the predetermined coefficient is determined according to a difference between the toner density of the developer and a target value for the toner density.

16. The electrophotographic image forming apparatus of claim 14, wherein the powder conveying pump is stopped to be driven a predetermined time after having been started to be driven.

17. A toner recycling device of an electrophotographic image forming apparatus to convey collected used toner to a developing device of the image forming apparatus, comprising:

means for conveying the collected used toner to the developing device of the image forming apparatus when an integrated value of predetermined numerical values, each based on a number of picture elements, is equal to or greater than a constant value; and means for adding a predetermined constant value to the integrated value when driving of an image bearing member of the image forming apparatus is detected.

18. A toner recycling device of an electrophotographic image forming apparatus to convey collected used toner to a developing device of the image forming apparatus, comprising:

means for conveying the collected used toner to the developing device of the image forming apparatus when an integrated value of predetermined numerical values, each based on a number of picture elements of an image to be formed, is equal to or greater than a constant value; and means for determining a predetermined coefficient according to toner density of a developer of the image forming apparatus and for correcting each of the predetermined numerical values by multiplying each of the predetermined numerical values by the predetermined coefficient.

19. A toner recycling device of an electrophotographic image forming apparatus to convey collected used toner to a developing device of the image forming apparatus, comprising:

means for conveying the collected used toner to the developing device of the image forming apparatus when an integrated value of numerical values, each based on a number of picture elements of an image to be formed, is equal to or greater than a constant value;

means for adding a predetermined constant value to the integrated value when driving of an image bearing member of the image forming apparatus is detected; and means for determining a predetermined coefficient according to toner density of a developer of the image forming apparatus and for correcting each of the predetermined numerical values by multiplying the each of the predetermined numerical values by the predetermined coefficient.

20. An electrophotographic image forming apparatus, comprising:

means for developing a latent image formed on a photoconductor with a toner; and means for recycling collected used toner to the developing means, the recycling means including, means for conveying the collected used toner to the developing means when an integrated value of predetermined numerical values, each based on a number of picture elements of an image to be formed, is equal to or greater than a constant value; and means for adding a predetermined constant value to the integrated value when driving of the photoconductor is detected.

21. An electrophotographic image forming apparatus, comprising:

means for developing a latent image formed on a photoconductor with a toner; and means for recycling collected used toner to the developing means, the recycling means including, means for conveying the collected used toner to the developing means when an integrated value of predetermined numerical values, each based on a number of picture elements of an image to be formed, is equal to or greater than a constant value; and means for determining a predetermined coefficient according to toner density of a developer of the image forming apparatus and for correcting each of the predetermined numerical values by multiplying the each of the predetermined values by the coefficient.

22. An electrophotographic image forming apparatus, comprising:

means for developing a latent image formed on a photoconductor with a toner; and means for recycling collected used toner to the developing means, the recycling means including, means for conveying the collected used toner to the developing means when an integrated value of predetermined numerical values, each based on a number of picture elements of an image to be formed, is equal to or greater than a constant value;

means for adding a predetermined constant value to the integrated value when driving of the photoconductor is detected; and means for determining a predetermined coefficient according to toner density of a developer of the image forming apparatus and for correcting each of the predetermined numerical values by multiplying the each of the predetermined numerical values by the coefficient.

23. A toner recycling method of an electrophotographic image forming apparatus, comprising the steps of:

driving a powder conveying pump to convey collected used toner to a developing device of the image forming apparatus when an integrated value of predetermined numerical values, each based on a number of picture elements of an image to be formed, is equal to or greater than a constant value; and adding a predetermined constant value to the integrated value when driving of an image bearing member of the image forming apparatus is detected.

24. The toner recycling method of claim 23, wherein, in the driving step the powder conveying pump is stopped to be driven a predetermined time after having been started to be driven.

25. A toner recycling method of an electrophotographic image forming apparatus, comprising the steps of:

driving a powder conveying pump to convey collected used toner to a developing device of the image forming apparatus when an integrated value of predetermined numerical values, each based on a number of picture elements of an image to be formed, is equal to or greater than a constant value; and determining a predetermined coefficient according to toner density of a developer of the image forming apparatus and correcting each of the predetermined numerical values by multiplying the each of the predetermined numerical values by the coefficient.

26. The toner recycling method of claim 25, wherein, in the determining step the coefficient is determined according to a difference between the toner density of the developer and a target value for the toner density.

27. The toner recycling method of claim 25, wherein, in the driving step the powder conveying pump is stopped to be driven a predetermined time after having been started to be driven.

28. A toner recycling method of an electrophotographic image forming apparatus, comprising the steps of:

driving a powder conveying pump to convey collected used toner to a developing device of the image forming apparatus when an integrated value of predetermined numerical values, each based on a number of picture elements of an image to be formed, is equal to or greater than a constant value;

adding a predetermined constant value to the integrated value when driving of an image bearing member of the image forming apparatus is detected; and determining a predetermined coefficient according to toner density of a developer of the image forming apparatus and correcting each of the predetermined numerical values by multiplying each of the predetermined numerical values by the coefficient.

29. The toner recycling method of claim 28, wherein, in the determining step the coefficient is determined according to a difference between the toner density of the developer and a target value for the toner density.

30. The toner recycling method of claim 28, wherein, in the driving step the powder conveying pump is stopped to be driven a predetermined time after having been started to be driven.

31. An electrophotographic image forming method, comprising the steps of:

developing a latent image formed on a photoconductor with a toner; and recycling collected used toner to a developing device, the recycling including, driving a powder conveying pump to convey the collected used toner to the developing device when an integrated value of predetermined numerical values, each based on a number of picture elements of an image to be formed, is equal to or greater than a constant value; and adding a predetermined constant value to the integrated value when driving of the photoconductor is detected.

32. The electrophotographic image forming method of claim 31, wherein, in the driving step the powder conveying pump is stopped to be driven a predetermined time after having been started to be driven.

33. An electrophotographic image forming method, comprising:

developing a latent image formed on a photoconductor with a toner by a developing device; and recycling collected used toner to the developing device, the recycling including, driving a powder conveying pump to convey the collected used toner to the developing device when an integrated value of predetermined numerical values, each based on a number of picture elements of an image to be formed, is equal to or greater than a constant value; and determining a predetermined coefficient according to toner density of a developer of the image forming apparatus and correcting each of the predetermined numerical values by multiplying the each of the predetermined numerical values by the predetermined coefficient.

34. The electrophotographic image forming method of claim 33, wherein in the determining step the coefficient is determined according to a difference between the toner density of the developer and a target value for the toner density.

35. The electrophotographic image forming method of claim 33, wherein, in the driving step the powder conveying pump is stopped to be driven a predetermined time after having been started to be driven.

36. An electrophotographic image forming method, comprising:

developing a latent image formed on a photoconductor with a toner by a developing device; and recycling collected used toner to the developing device, the recycling including, driving a powder conveying pump to convey the collected used toner to the developing device when an integrated value of predetermined numerical values, each based on a number of picture elements of an image to be formed, is equal to or greater than a constant value;

adding a predetermined constant value to the integrated value when driving of the photoconductor is detected; and determining a predetermined coefficient according to toner density of a developer of the image forming apparatus and for correcting each of the predetermined numerical values by multiplying the each of the predetermined numerical values by the predetermined coefficient.

37. The electrophotographic image forming method of claim 36, wherein in the determining step the coefficient is determined according to a difference between the toner density of the developer and a target value for the toner density.

38. The electrophotographic image forming method of claim 36, wherein, in the driving step the powder conveying pump is stopped to be driven a predetermined time after having been started to be driven.

* * * * *